United States Patent [19]

Lee

[11] 4,206,914

[45] Jun. 10, 1980

[54] WORK CONTROL APPARATUS IN AN EXERCISER

[75] Inventor: Cleve L. Lee, St. Louis, Mo.

[73] Assignee: The Perfection Manufacturing Company, St. Louis, Mo.

[21] Appl. No.: 893,049

[22] Filed: Apr. 3, 1978

[51] Int. Cl.[2] ..... A63B 69/16

[52] U.S. Cl. ..... 272/73; 272/DIG. 5; 272/132

[58] Field of Search ..... 272/73, DIG. 4, DIG. 5, 272/132; 74/415, 435, 84 R, 84 S, 126, 127, 128, 813 R, 813 C, 813 L

[56] References Cited

U.S. PATENT DOCUMENTS

| | | | |
|---|---|---|---|
| 3,501,142 | 3/1970 | Johansson | 272/73 |

FOREIGN PATENT DOCUMENTS

| | | | |
|---|---|---|---|
| 730035 | 3/1966 | Canada | 272/73 |
| 52402 | 6/1908 | Fed. Rep. of Germany | 272/73 |
| 551455 | 11/1956 | Italy | 74/84 |

OTHER PUBLICATIONS

Fitness Cycle, The New York Times, Sunday, Aug. 14, 1977, p. 39.

*Primary Examiner*—Richard C. Pinkham
*Assistant Examiner*—Arnold W. Kramer
*Attorney, Agent, or Firm*—Cohn, Powell & Hind

[57] ABSTRACT

A work control apparatus in a bicycle exerciser having a driven member rotatively mounted on an exerciser frame, the work control apparatus having a rotatively mounted knob connected to a brake for the driven member for selectively determining the braking pressure exerted on the driven member, the knob being drivingly connected to a rotatively mounted wheel for rotating the wheel an angular distance less than the corresponding angular distance of the knob upon rotation of the knob incident to adjusting the braking pressure. An indicator on the wheel indicates the braking pressure applied by the brake to the driven member at a particular rotatively adjusted position of the knob. The knob and wheel are interconnected to intermittently engage to rotate the wheel in stepped angular increments upon continuous angular movement of the knob. The connection between the knob and wheel is provided by a plurality of angularly spaced drive pins intermittently engaging the wheel in a plurality of angularly spaced notches. In one embodiment, the rod is threadedly attached to and is carried by the brake frame, the knob being fixed to one end of the rod, and the other end of the rod engaging the exerciser frame, the threaded longitudinal adjustment of the rod upon rotation of the knob causing pivotal movement of the brake frame and exerting a predetermined braking pressure between a roller on the brake frame and the driven member.

3 Claims, 6 Drawing Figures

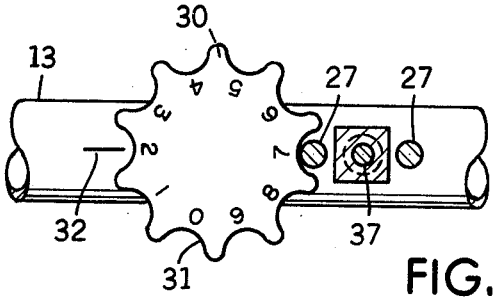
FIG. 5
FIG. 4
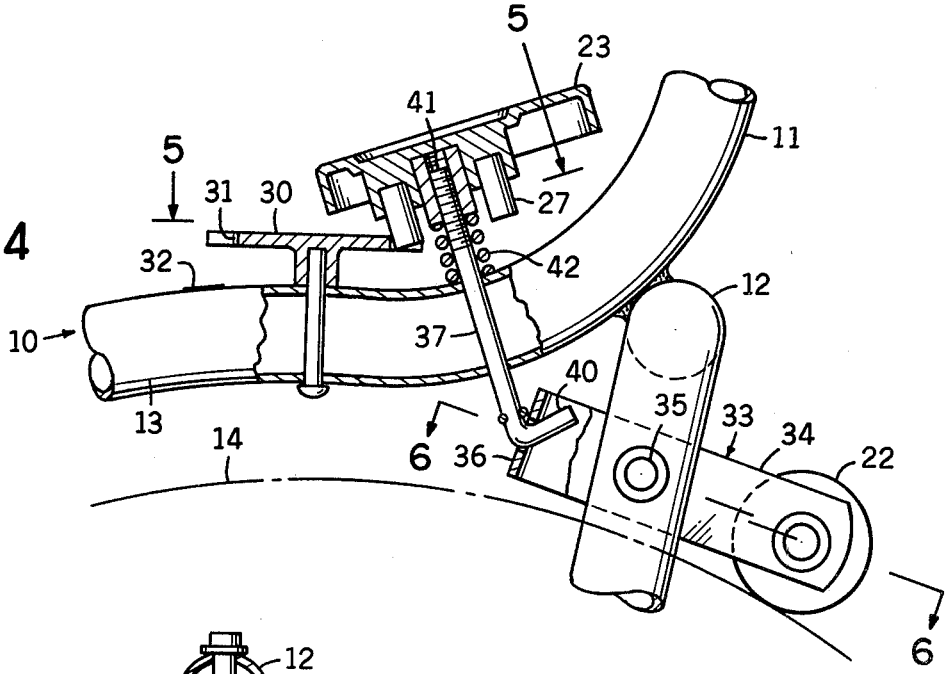
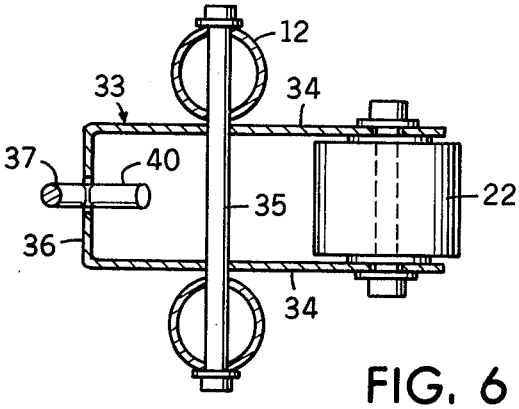
FIG. 6

WORK CONTROL APPARATUS IN AN EXERCISER

BACKGROUND OF THE INVENTION

This invention relates generally to improvements in a work control apparatus in an exerciser, and more particularly to an improved apparatus in a bicycle exerciser which enables an easy and ready adjustment to a predetermined braking pressure on the driven wheel.

In the heretofore conventional work control apparatus utilized in an exerciser of this type, when the knob, which was used to regulate and indicate the braking pressure, was turned more than one revolution to reach a predetermined braking pressure, and then subsequently moved from such adjusted position, it was difficult if not impossible to then subsequently readjust the knob to the previously determined braking pressure simply by reliance upon the indicator provided on the knob.

SUMMARY OF THE INVENTION

The present work control apparatus overcomes the functional disadvantages of the heretofore conventional apparatus discussed previously. It readily permits the knob, which regulates the braking pressure, to be readily turned and located to provide any previously determined braking pressure.

The work control apparatus includes a rotatively mounted knob connected to a brake means that operatively engages a driven member for selectively determining the braking pressure exerted on the driven member. The knob is drivingly connected to a rotatively mounted wheel for rotating the wheel an angular distance less than the corresponding angular distance of the knob upon rotation of the knob incident to adjusting the braking pressure. An indicator means on the wheel indicates the braking pressure applied by the brake means to the driven member at a particular rotatively adjusted position of the knob.

More particularly, the knob and wheel have means that intermittently engage to rotate the wheel in stepped angular increments upon continuous angular movement of the knob.

The intermittent connection between the wheel and knob is provided by a plurality of angularly spaced drive pins on the knob that intermittently engage a plurality of angularly spaced notches spaced regularly about the periphery of the wheel. In a preferred embodiment, the knob drive pins are angularly spaced substantially in 180 ° relation about the rotative axis of the knob. Accordingly, upon a full 360° revolution of the knob, the wheel is rotated only the angular distance represented by two notches on the wheel periphery, i.e., a total of 72° when ten regularly spaced notches are used as disclosed.

The brake means of the work control apparatus includes a brake frame pivotally mounted to the exerciser frame on a pivot axis, a friction member carried by the brake frame at one side of the pivot axis and engaging the driven member, and a rod attached to the brake frame at the other side of the pivot axis and attached to the knob.

In one embodiment, the rod extends through the exerciser frame, and the knob is threadedly mounted on and is rotatively adjustable about the rod. A spring is located about the rod and located between the knob and the exerciser frame to exert a predetermined braking pressure between the friction member and driven member depending upon the threadedly adjusted angular position of the knob.

In another embodiment, the rod is threadedly attached to and is carried by the brake frame, the knob being fixed to one end of the rod, and the other end of the rod engaging the exerciser frame. The threaded longitudinal adjustment of the rod upon rotation of the knob causes pivotal movement of the brake frame and exerts the predetermined braking pressure between the friction member and driven member.

BRIEF DESCRIPTION OF THE DRAWINGS

FIG. 4 is a cross sectional view of another embodiment of the work control apparatus as taken on a longitudinal axis;

FIG. 5 is a fragmentary, cross sectional view as taken on staggered line 5—5 of FIG. 4, and FIG. 6 is a cross sectional view as taken on line 6—6 of FIG. 4.

DESCRIPTION OF THE PREFERRED EMBODIMENTS

Figure 1:
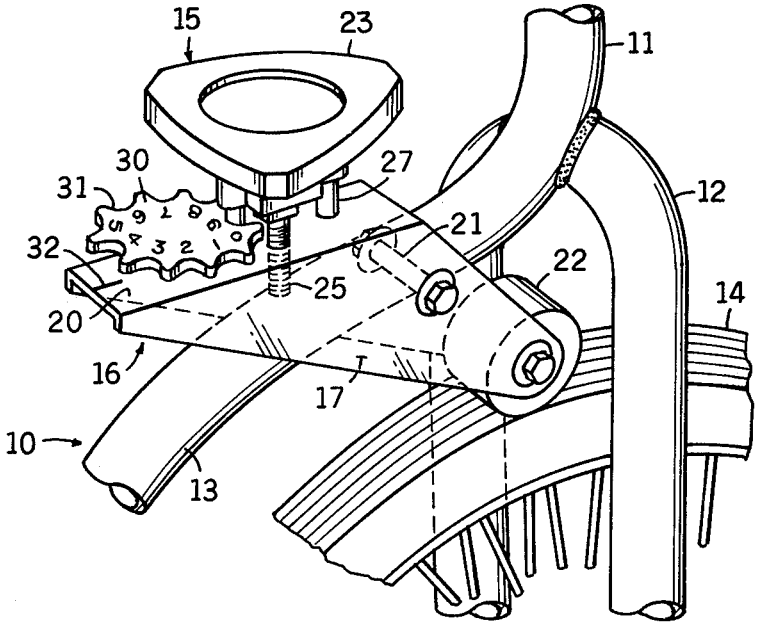
FIG. 1 is a perspective view of one embodiment of the work control apparatus in an exerciser.

Referring now by characters of reference to the drawings, and first to FIG. 1, it will be understood that the exerciser 10 is of the bicycle type having an exerciser frame 11 with a front fork portion 12 and an intermediate, longitudinal frame portion 13. As is usual, a wheel 14, constituting a driven member, is rotatively mounted between the frame fork 12 and below the longitudinal frame portion 13. Also as is conventional, and therefore not shown, is an appropriate drive means such as foot pedal and sprocket-chain connection with the driven wheel 14, whereby the user can use leg power to rotate the driven wheel 14.

Figure 3:
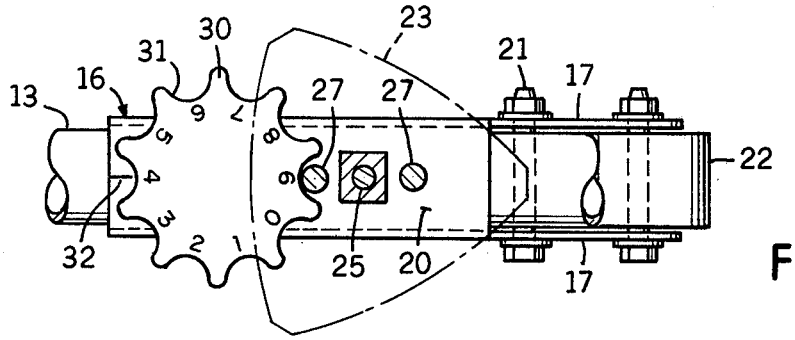
FIG. 3 is a cross sectional view as taken on staggered line 3—3 of FIG. 2.
Figure 2:
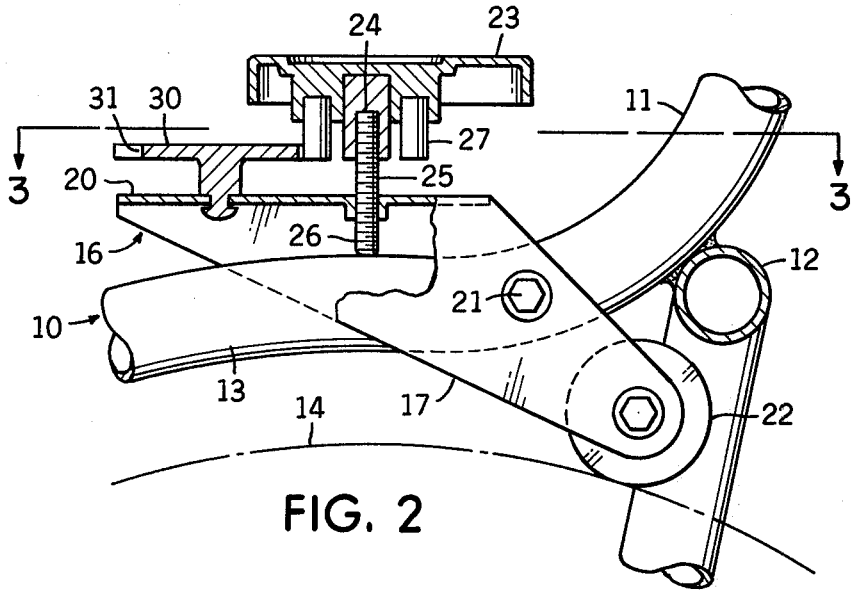
FIG. 2 is a fragmentary, cross sectional view longitudinally of the work control apparatus shown in FIG. 1.

In the embodiment disclosed in FIGS. 1-3, the work control apparatus generally indicated by 15 includes a brake frame referred to by 16 having opposed side plates 17 disposed on opposite sides of the longitudinal frame portion 13, and an integral top web plate 20. The brake frame 16 is pivotally mounted to the exerciser frame portion 13 by a pivot pin 21 interconnecting the side plates 17 and extending through the frame portion 13, the pivot pin 21 defining a pivot axis.

A roller 22, constituting a friction member, is rotatively mounted between the side plates 17 of the brake frame 16 at one side of the pivot axis defined by pivot pin 21, the roller 22 engaging the periphery of the driven wheel 14.

A manually-actuated knob 23 is fixed to one end 24 of a threaded rod 25, the rod 25 being threadedly attached to and extending through the top web plate 20 of brake frame 16. The opposite end 26 of threaded rod 25 engages the upper surface of the longitudinal frame portion 13. Upon rotation of the knob 23, the longitudinal extension of rod 25 below the top web plate 20 will vary and consequently pivot the brake frame 16 about the axis of pivot pin 21, thereby exerting selectively braking pressure between the roller 22 and the driven wheel 14.

Attached to and depending from the knob 23, is a pair of drive pins 27 angularly spaced substantially in 180° relation about the rotative axis of the knob 23.

Rotatively mounted on the top web plate 20 is an indicator wheel 30 that is provided with a plurality of notches 31 angularly spaced regularly about the periphery of the wheel 30. In the embodiment disclosed, a total of ten such notches 31 are provided. The drive pins 27 are adapted to interfit the notches 31 and rotate the wheel 30 intermittently as the knob 23 is rotated, the indicator wheel 30 being moved in stepped angular increments upon continuous angular movement of the knob 23. It will be understood that the indicator wheel is rotated an angular distance less than the corresponding angular distance of the knob 23 upon rotation of the knob 23 incident to adjusting the braking pressure.

The indicator wheel 30 is provided with indicia, constituting indicator means, to indicate the braking pressure applied by the roller 22 to the driven wheel 14 at a particular rotatively adjusted position of the knob 23. For example, a reference mark 32 is provided at one end of the top web plate 20 closely adjacent the periphery of the indicator wheel 30, the particular indicia indicated by the reference mark 32 representing the particular adjusted braking pressure.

In use, the user will turn the knob 23 to pivot the brake frame 16 and thereby provide a desired predetermined braking pressure between the roller 22 and driven wheel 14. At the knob 23 is rotated, the drive pins 27 will rotate the indicator wheel 30 in the notches 31 in stepped angular increments. The knob 23 may be rotated more than one full revolution without causing a full corresponding revolution of the indicator wheel 30. When a pair of drive pins 27 are utilized, which are located in 180° relationship, the indicator wheel 30 is moved in stepped increments for a total of 72° for each 360° movement of the knob 23. Consequently, when a desired predetermined braking pressure is attained, a reading of the indicia on the indicator wheel 30 with the reference mark 32 can be made, and accordingly, if such predetermined pressure is again desired at any time, the knob 23 can be rotated until the same reading is attained, even though the knob 23 must be rotated more than one revolution. It will be understood that such braking pressure is quickly and easily provided.

Another embodiment is disclosed in FIGS. 4–6. The same reference numerals will be utilized to indicate the corresponding parts where possible for clarity of disclosure.

In this embodiment, the brake frame referred to by 33 includes a pair of side plates 34 located between and pivotally attached to the fork frame 12 by a pivot pin 35, the pivot pin 35 providing a pivot axis. An integral web plate 36 interconnects one end of the side frame plates 34.

The roller 22, constituting a friction member, is pivotally mounted between and to the side plates 34 at one side of the pivot axis provided by pivot pin 35, the roller 22 engaging the driven wheel 14.

A rod 37 has one end 40 attached to the web plate 36 at the opposite side of the axis provided by pivot pin 35. The rod 37 extends freely through the longitudinal frame portion 13. The manually-actuated knob 23 is mounted on and is threadedly adjustable on the other end 41 of rod 37. Located about the rod 37 and located between the underside of knob 23 and the top of frame portion 13, is a compression spring 42. The spring 42 exerts a braking pressure through the rod 37 and pivoted brake frame 33, between the roller 22 and driven wheel 14.

The indicator wheel 30 is pivotally mounted to the longitudinal frame portion 13 adjacent the knob 23 so that the knob drive pins 27 engage the indicator wheel 30 in the peripheral notches 31.

The operation and functional advantages of the embodiments of FIGS. 4–6 are the same as that previously described with respect to the embodiment of FIGS. 1–3. The user can exert a predetermined braking pressure between the roller 22 and the driven wheel 14 by rotating the knob 23. Upon rotation of knob 23, the loading of spring 42 will be varied depending upon the threaded longitudinal adjustment of the knob 23 on the threaded rod end 41. Moreover, upon rotation of knob 23, the drive pins 27 will rotate the indicator wheel 30 intermittently in stepped angular increments upon continuous angular movement of the knob 23 as the drive pins 27 engage the wheel 30 in the notches 31. The reference mark 32 is provided on the upper surface of the longitudinal frame portion 13 adjacent the periphery of the indicator wheel 30 so as to cooperate functionally with the indicia provided on the indicator wheel 30 in the manner previously described.

Again, it will be importantly understood that with this embodiment of FIGS. 4–6, as with the embodiment of FIGS. 1–3, any desired predetermined braking pressure between the roller 22 and the drive wheel 14 can be quickly and easily applied upon manual rotation of knob 23, even though knob 23 must be rotated more than one revolution. This is achieved by the fact that the drive pins 27, upon rotation of knob 23, intermittently rotate the indicator wheel 30 in notches 31, in stepped angular increments for an overall angular movement of less than one revolution. More particularly, it will be understood that with the drive pins 27 located in 180° relation, and with a total of ten regularly spaced notches 31, the knob 23 can be rotated five complete revolutions before the indicator wheel 30 is rotated one revolution.

I claim as my invention:

1. A work control apparatus in an exerciser having a frame, and a driven member rotatively mounted on the frame, comprising:

(a) a brake means operatively engaging the driven member and mounted on the exerciser frame, (b) a rotatively mounted knob connected to the brake means for selectively determining the braking pressure exerted on the driven member, (c) a rotatively mounted wheel, (d) means drivingly interconnecting the knob and wheel for rotating the wheel an angular distance less than the corresponding angular distance of the knob upon rotation of the knob incident to adjusting the braking pressure, (e) indicator means associated with the wheel to indicate the braking pressure applied by the brake means to the driven member at a particularly rotatively adjusted position of the knob, (f) the means drivingly interconnecting the knob and wheel including:

1. a plurality of angularly spaced notches on the wheel, and 2. a plurality of angularly spaced drive pins on and depending from the knob intermittently engaging the wheel in the notches to rotate the wheel in stepped angular increments upon continuous angular movement of the knob, (g) the brake means including:

1. a brake frame pivotally mounted to the exerciser frame on a pivot axis,
2. a friction member carried by the brake frame at one side of the pivot axis and engaging the drive member, and
3. a rod attached to the brake frame at the other side of the pivot axis, and (h) the knob being mounted on the rod with the depending drive pins interfitting the wheel notches and movable rotatively in the notches longitudinally substantially in the direction of the longitudinal axis of the rod for maintaining operative engagement with the wheel upon pivotable movement of the brake frame.

2. A work control apparatus in an exerciser as defined in claim 1, in which:

(i) the rod is movable longitudinally and extends through the exerciser frame, (j) the knob is threadedly mounted on and is rotatively adjustable about the rod to intermittently engage the depending drive pins with the wheel in the notches and to move the drive pins longitudinally in the notches for maintaining operative engagement with the wheel as the rod moves longitudinally upon pivotal movement of the brake frame, (k) spring means is located about the rod, one end of which engages the knob and the other end of which engages the exerciser frame to exert a predetermined braking pressure between the friction member and driven member dependent on the threadedly adjusted angular position of the knob, and (l) the wheel is rotatively mounted on the exerciser frame.

3. A work control apparatus in an exerciser as defined in claim 1, in which:

(i) the rod is threadedly attached to and is carried by the brake frame, (j) the knob is fixed to one end of the rod, the other end of the rod being engageable with the exerciser frame for longitudinal adjustment of the rod upon rotation of the knob to pivot the brake frame and exert a predetermined braking pressure between the friction member and driven member, and (k) the wheel is rotatively mounted on the brake frame to intermittently engage the depending drive pins with the wheel in the notches and to move the drive pins rotatively longitudinally in the notches for maintaining operative engagement with the wheel as the wheel moves with the brake frame upon pivotal movement of the brake frame.

* * * * *